US010106929B2

(12) United States Patent
Hirata

(10) Patent No.: US 10,106,929 B2
(45) Date of Patent: Oct. 23, 2018

(54) METHOD OF PRODUCING SCENTED TISSUE PAPER PRODUCT

(71) Applicant: DAIO PAPER CORPORATION, Ehime (JP)

(72) Inventor: Norimitsu Hirata, Shizuoka (JP)

(73) Assignee: DAIO PAPER CORPORATION, Ehime (JP)

( * ) Notice: Subject to any disclaimer, the term of this patent is extended or adjusted under 35 U.S.C. 154(b) by 266 days.

(21) Appl. No.: 15/116,914

(22) PCT Filed: Feb. 17, 2015

(86) PCT No.: PCT/JP2015/054242

§ 371 (c)(1),
(2) Date: Aug. 5, 2016

(87) PCT Pub. No.: WO2015/129510

PCT Pub. Date: Sep. 3, 2015

(65) Prior Publication Data

US 2017/0175336 A1 Jun. 22, 2017

(30) Foreign Application Priority Data

Feb. 28, 2014 (JP) ..... 2014-038505

(51) Int. Cl.
*D21H 21/54* (2006.01)
*B65D 71/08* (2006.01)
(Continued)

(52) U.S. Cl.
CPC ..... *D21H 21/54* (2013.01); *A47K 10/20* (2013.01); *B65D 5/0227* (2013.01);
(Continued)

(58) Field of Classification Search
CPC ..... D21H 21/54; D21H 17/24; D21H 19/44; D21H 27/002
See application file for complete search history.

(56) References Cited

U.S. PATENT DOCUMENTS 3,516,941 A 6/1970 Matson et al.
4,990,381 A 2/1991 Holzner
(Continued)

FOREIGN PATENT DOCUMENTS

CA 971135 A 7/1975
CN 202138683 U 2/2012
(Continued)

OTHER PUBLICATIONS

International Search Report of corresponding application No. PCT/JP2015/054242 dated May 26, 2015.
(Continued)

*Primary Examiner* — Jeffry H Aftergut
*Assistant Examiner* — Jaeyun Lee
(74) *Attorney, Agent, or Firm* — Maier & Maier, PLLC

(57) ABSTRACT

To provide a method of producing scented tissue paper. The problem is solved by performing shrink wrapping in which a tissue paper housing obtained by carrying fragrance-containing microcapsules on an inner surface of a housing box using a binder is covered with a shrink film and the shrink film is exposed to hot air W so as to be attached to the tissue paper housing, causing the fragrance-containing microcapsules to be detached from the binder by heating the tissue paper housing at the time of the shrink wrapping, and providing the scent for plural sheets of tissue papers.

8 Claims, 8 Drawing Sheets

(51) Int. Cl.

| | |
|---|---|
| ***B65D 75/00*** | (2006.01) |
| ***B65D 83/08*** | (2006.01) |
| ***D21H 25/06*** | (2006.01) |
| ***D21H 27/10*** | (2006.01) |
| ***D21H 17/31*** | (2006.01) |
| ***D21H 19/44*** | (2006.01) |
| ***A47K 10/20*** | (2006.01) |
| ***B65D 5/02*** | (2006.01) |
| ***B65D 5/42*** | (2006.01) |
| ***B65D 5/54*** | (2006.01) |
| ***B65D 5/56*** | (2006.01) |
| ***B65D 5/72*** | (2006.01) |
| ***B65D 77/00*** | (2006.01) |
| ***D21H 17/24*** | (2006.01) |
| ***D21H 27/00*** | (2006.01) |

(52) U.S. Cl.

CPC ..... *B65D 5/4266* (2013.01); *B65D 5/542* (2013.01); *B65D 5/563* (2013.01); *B65D 5/72* (2013.01); *B65D 71/08* (2013.01); *B65D 75/002* (2013.01); *B65D 75/004* (2013.01); *B65D 77/003* (2013.01); *B65D 83/0805* (2013.01); *B65D 83/0894* (2013.01); *D21H 17/24* (2013.01); *D21H 17/31* (2013.01); *D21H 19/44* (2013.01); *D21H 25/06* (2013.01); *D21H 27/002* (2013.01); *D21H 27/10* (2013.01); *B65D 2203/12* (2013.01)

(56) References Cited

U.S. PATENT DOCUMENTS

| | | | |
|---|---|---|---|
| 2004/0050741 | A1 | 3/2004 | Prater |
| 2004/0124101 | A1 | 7/2004 | Mitchell et al. |
| 2006/0198960 | A1 | 9/2006 | Calvert et al. |

FOREIGN PATENT DOCUMENTS

| | | | |
|---|---|---|---|
| JP | 1-210488 | A | 8/1989 |
| JP | H01210488 | A | 8/1989 |
| JP | 07-021584 | U | 4/1995 |
| JP | 2003-292030 | A | 10/2003 |
| JP | 2010-52815 | A | 3/2010 |
| JP | 2012-196382 | A | 10/2012 |
| WO | 2008/136721 | A1 | 11/2008 |
| WO | 2011077491 | A1 | 6/2011 |

OTHER PUBLICATIONS

Notice of Ground for Rejection dated Dec. 19, 2017 of corresponding Korean application No. 10-2016-7020901; 17 pgs.

China Office Action of corresponding application No. CN201580010547.2 dated Jun. 9, 2017. (27 pgs).

Extended European Search Report of corresponding application No. EP15755746 dated Jan. 26, 2017. (11 pgs).

Chinese Office Action dated Jul. 17, 2018 of corresponding Application No. CN201580010547.2; 23 pgs.

[FIG. 1]
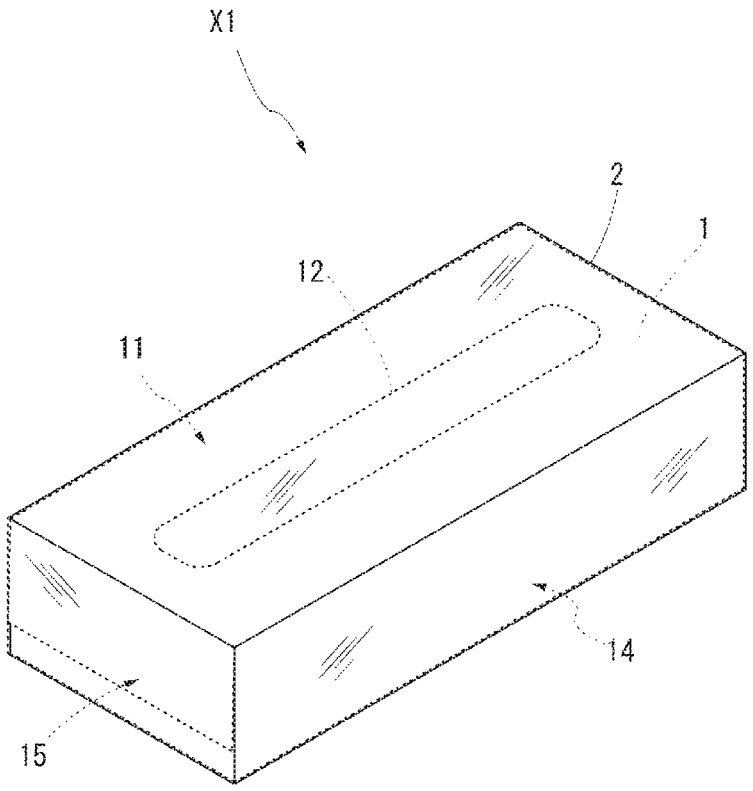

[FIG. 2]
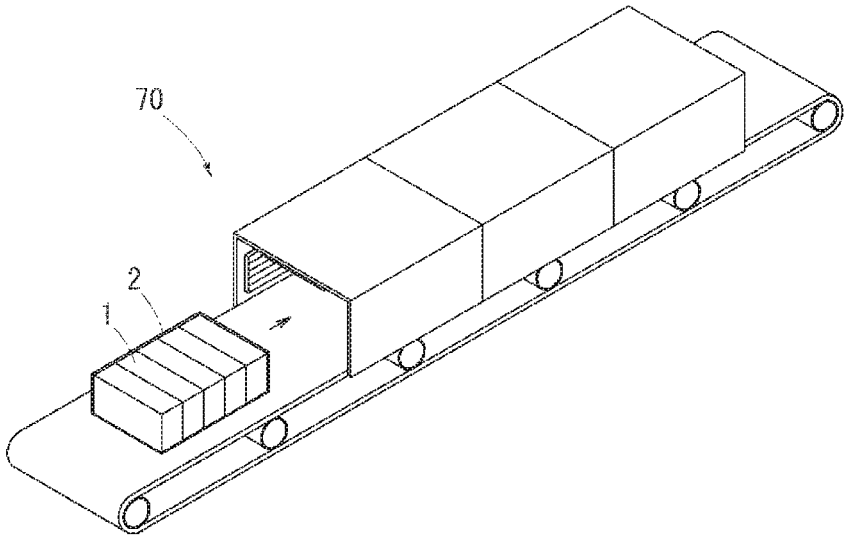

[FIG. 3]
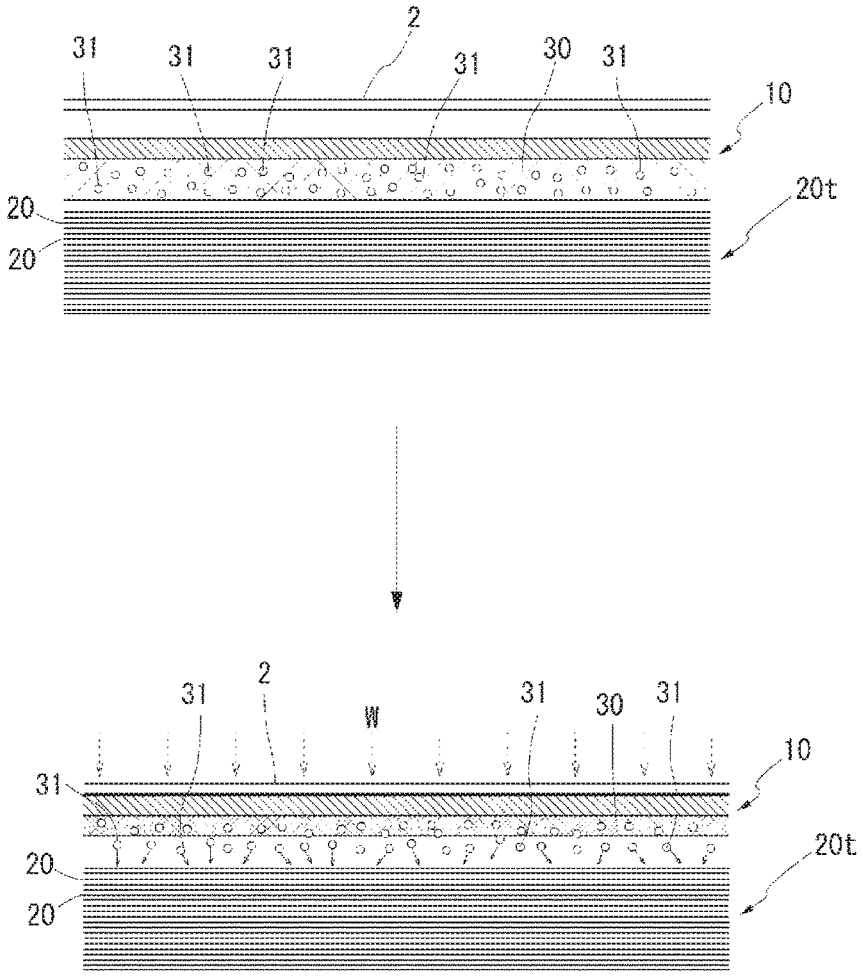

[FIG. 4]
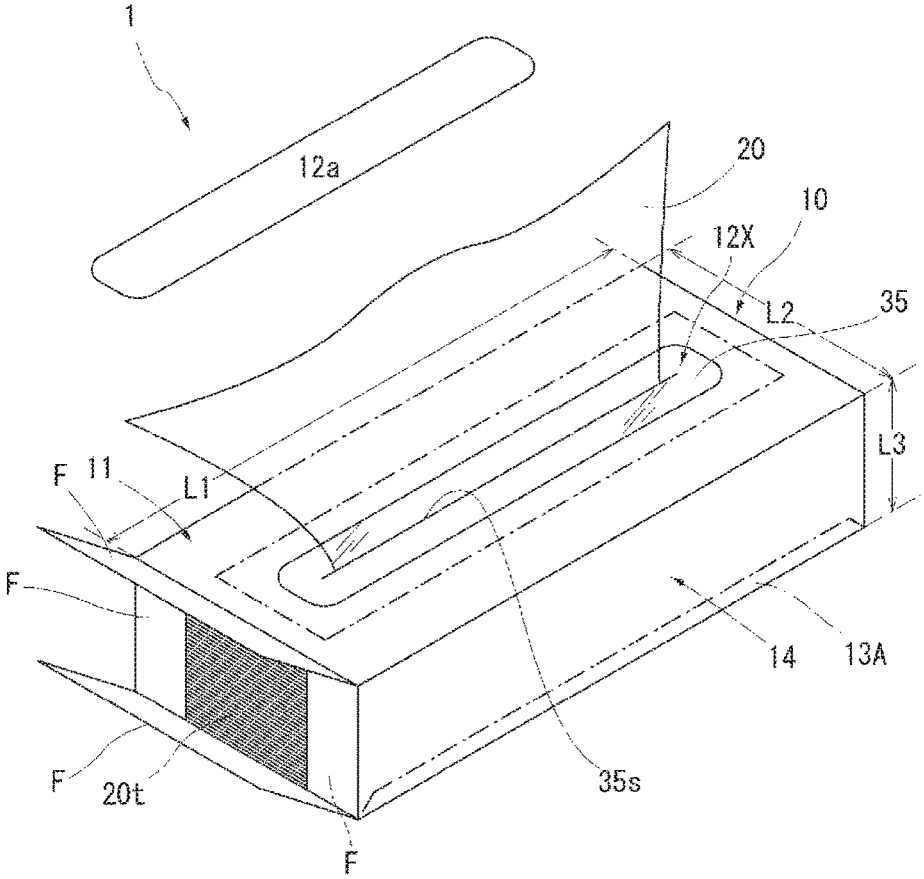

[FIG. 5]
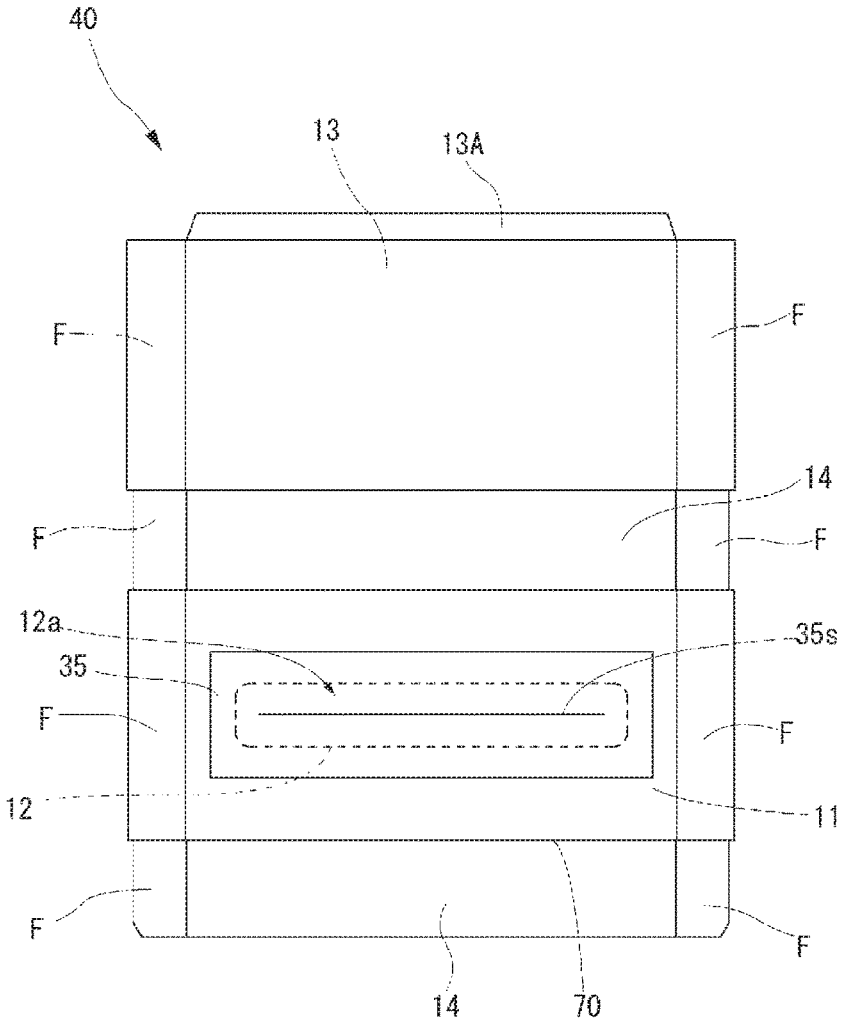

[FIG. 6]
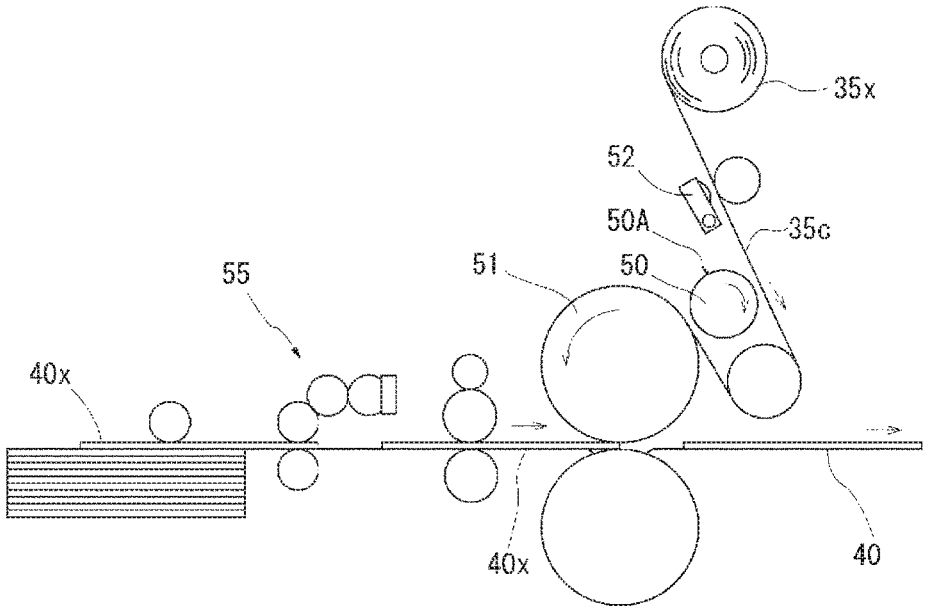

[FIG. 7]
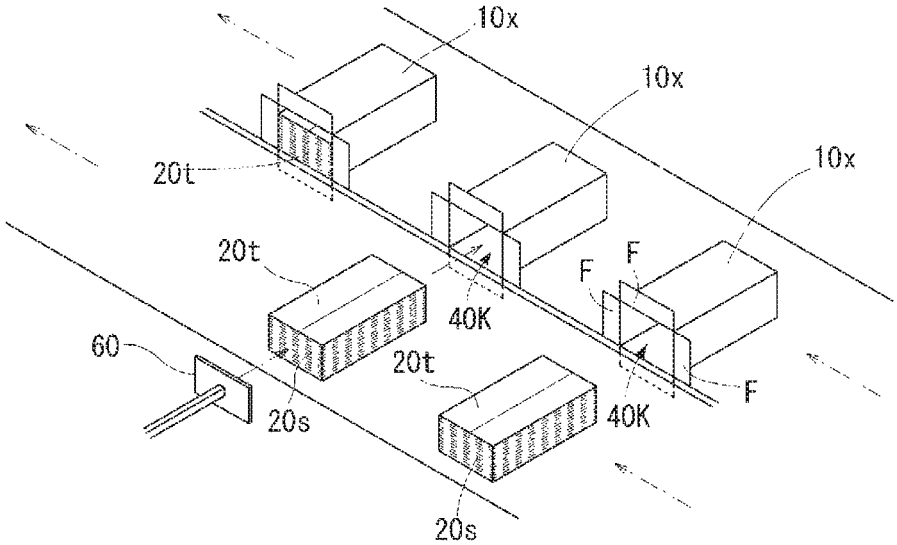

[FIG. 8]
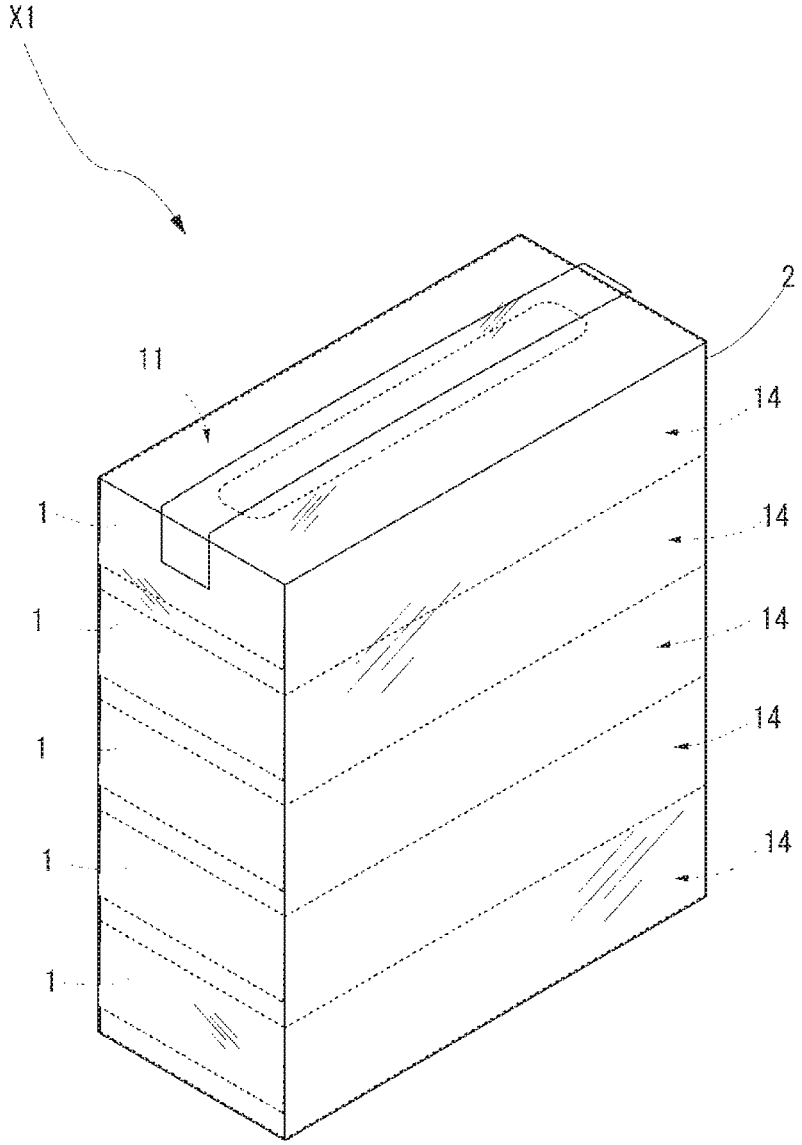

METHOD OF PRODUCING SCENTED TISSUE PAPER PRODUCT

TECHNICAL FIELD

The present invention relates to a method of producing a tissue paper product, particularly, a scented tissue paper product.

BACKGROUND ART

A tissue paper housing formed by storing a bundle of plural sheets of tissue papers being folded and stacked on each other in a rectangular parallelepiped housing box, also referred to as a carton, is well known. One tissue paper housing is wrapped with a film and then made into a product or three to five tissue paper housings are stacked and wrapped with a film and then made into a product.

Some of tissue paper products are scented products. In the related art, these scented tissue paper products are produced by coating tissue paper with fragrance-containing microcapsules formed by encapsulating a fragrance in microcapsules to obtain scented tissue paper.

However, this method has problems in that the production cost is extremely high because the yield of fragrance-containing microcapsules when applied to tissue paper is poor and it takes time and effort to wash a machine at the time of exchange the production of tissue paper coated with a fragrance with production of tissue paper which is not coated with a fragrance and accordingly, the loss of production exchange is huge. Therefore, the price of the product is expensive and this has been an obstacle to spreading the product.

In recent years, scented tissue paper products obtained by allowing a film provided with a slit, included in a typical housing box structure of a tissue paper housing, to contain a fragrance and providing the fragrance volatilized from the film provided with a slit for tissue paper in the housing box using a mechanism of a lingering scent are commercially available. Such scented tissue paper can be produced at a low cost compared to tissue paper obtained by providing fragrance-containing microcapsules directly for tissue paper.

However, since such scented tissue paper is obtained by a fragrance volatilized from a film provided with a slit entering the surface of fibers or between fibers of tissue paper such that an aroma is provided using a mechanism of a lingering scent, an aroma is sufficiently transferred in a case of tissue paper having a large space on the surface of fibers and between fibers, but an aroma is unlikely to be transferred in a case of tissue paper having a small space on the surface of fibers or between fibers. For example, in tissue paper, there is moisturizing tissue paper obtained by applying a humectant to tissue paper, but an aroma is unlikely to be provided for such moisturizing tissue paper using the above-described mechanism because a space for an aroma to enter is small in moisturizing tissue paper due to a humectant being present on the surface of fibers or between fibers. Therefore, in a case of providing an aroma for moisturizing tissue paper, a conventional method of providing fragrance-containing microcapsules with a humectant for tissue paper is employed.

CITATION LIST

Patent Literature

[PTL 1] JP-A-2010-52815
[PTL 2] JP-A-2012-196382

SUMMARY OF INVENTION

Technical Problem

A main object of the present invention is to provide a method of directly providing the above-described fragrance-containing microcapsules for tissue paper, in which the loss of production exchange between a tissue paper product which is not scented and a scented tissue paper product is small, a problem of fragrance-containing microcapsules having a low yield is improved, and the aroma can be sufficiently provided for moisturizing tissue paper; and a method of producing a scented tissue paper product in which the problems of a scented tissue paper product obtained by allowing a film provided with a slit to contain a fragrance are solved.

Solution to Problem

The present invention that solves the above-described problems is as follows.

[Invention Described in Claim 1]

A method of producing a scented tissue paper product including: performing shrink wrapping in which a tissue paper housing obtained by carrying fragrance-containing microcapsules on an inner surface of a housing box using a binder is covered with a shrink film and the film is exposed to hot air so as to be attached to the tissue paper housing; and causing the fragrance-containing microcapsules to be detached from the binder by heating the tissue paper housing at the time of the shrink wrapping.

[Invention Described in Claim 2]

The method of producing a scented tissue paper product according to claim 1, in which the binder has a melting point of 55° C. to 85° C.

[Invention Described in Claim 3]

The method of producing a scented tissue paper product according to claim 1 or 2, in which the binder is gelatin, agarose, agar, or carrageenan.

[Invention Described in Claim 4]

The method of producing a scented tissue paper product according to any one of claims 1 to 3, in which the tissue paper housing is a housing which has a rectangular parallelepiped shape and in which a film provided with a slit is provided on the inner surface of the upper surface and fragrance-containing microcapsules are carried at least on the side surface using a binder.

[Invention Described in Claim 5]

The method of producing a scented tissue paper product according to claim 4, in which the shrink wrapping is performed by arranging a plurality of tissue paper housings on the upper surface and the bottom surface such that the tissue paper housings face each other.

[Invention Described in Claim 6]

The method of producing a scented tissue paper product according to any one of claims 1 to 5, further including: coating a carton blank base material, before a film provided with a slit is attached thereto, with a fragrance solution that contains fragrance-containing microcapsules and a binder; attaching a film provided with a slit to the carton blank base material to form a carton blank; and producing a tissue paper housing using the carton blank.

[Invention Described in Claim 7]

The method of producing a scented tissue paper product according to claim 6, in which an adhesive portion of the film provided with a slit is not coated with the fragrance solution.

[Invention Described in Claim 8]

The method of producing a scented tissue paper product according to any one of claims 1 to 7, in which tissue paper is moisturizing tissue paper including a humectant.

(Action Effects)

According to the method of producing a scented tissue paper product of the present invention, it is possible to reliably provide an aroma for tissue paper because fragrance-containing microcapsules are eventually provided for tissue paper, compared to a method of providing a fragrance volatilized from a film provided with a slit for tissue paper using a mechanism of a lingering scent. Further, it is possible to reliably provide the aroma for tissue paper even when the tissue paper is a type of tissue paper in which the aroma is unlikely to be provided using a mechanism of a lingering scent such as moisturizing tissue paper.

Moreover, according to the method of producing a scented tissue paper product of the present invention, since it is not necessary to provide a fragrance application process for a production line that handles tissue paper by carrying out a series of processes particularly from papermaking of tissue paper to storing the tissue paper in a housing box in the processes for manufacturing a tissue paper product, there is no need for exchange of production of tissue paper for which a fragrance is provided with production of tissue paper for which a fragrance is not provided, and thus the loss of production exchange is not generated. Consequently, it is not necessary to provide deodorizing equipment for such a production line.

In addition, since a housing box does not need to be as soft as tissue paper, when fragrance-containing microcapsules are carried on the inner surface of the housing box using a binder, the inner surface can be coated with a fragrance solution formed by dispersing fragrance-containing microcapsules in a highly viscous binder and then the housing box can be formed. That is, since fragrance-containing microcapsules can be applied with less physical stimulation compared to a case where fragrance-containing microcapsules are directly applied to tissue paper, it is possible to reduce collapse of fragrance-containing microcapsules during application and to produce tissue paper with a high yield.

In addition, since flagrance-containing microcapsules are carried on the inner surface of the housing box, even when the fragrance-containing microcapsules are detached from the housing box after the completion of the product, this does not lead to a loss of the flagrance-containing microcapsules because the flagrance-containing microcapsules remain in the housing box so that the aroma can be provided to tissue paper. Therefore, the waste of the flagrance-containing microcapsules is small.

Further, the shrink wrapping can be performed in the procedures similar to those of the related art and thus a new cost is not generated.

Moreover, scented tissue paper can be produced by coating a flat carton blank base material with flagrance-containing microcapsules. During this process, it is possible to easily select whether to apply the flagrance-containing microcapsules to a suitable site or not to apply the flagrance-containing microcapsules to an unsuitable site by means of printing or the like. Accordingly, the fragrance-containing microcapsules can be easily carried in a suitable site other than a site used for bonding for the purpose of bonding a film provided with a slit or for assembly of a housing box. Therefore, it is possible to produce scented tissue paper with excellent productivity without being affected by strength poverty or handleability of the tissue paper housing.

Advantageous Effects of Invention

According to the present invention described above, it is possible to provide a method of directly providing fragrance-containing microcapsules of the related art for tissue paper, in which the loss of production exchange between a tissue paper product which is not scented and a scented tissue paper product is small, a problem of fragrance-containing microcapsules having a low yield is improved, and the aroma can be sufficiently provided for moisturizing tissue paper; and a method of producing a scented tissue paper product in which the problems of a scented tissue paper product obtained by allowing a film provided with a slit to contain a fragrance are solved.

BRIEF DESCRIPTION OF DRAWINGS

FIG. 1 is a perspective view illustrating a tissue paper product according to an embodiment of the present invention.

FIG. 2 is a view schematically illustrating an aspect of a shrink wrapping device and shrink wrapping according to the embodiment of the present invention.

FIG. 3 is a view schematically illustrating the section of a carton at the time of shrink wrapping of the scented tissue paper product according to the embodiment of the present invention.

FIG. 4 is a perspective view for describing the structure of the tissue paper product according to the embodiment of the present invention.

FIG. 5 is a view illustrating a surface which is an inner surface of a carton blank box of a housing box according to the embodiment of the present invention.

FIG. 6 is a view for describing a method of producing a carton blank according to the embodiment of the present invention.

FIG. 7 is a view for describing storing a bundle of sheets of tissue paper in a housing box according to the embodiment of the present invention.

FIG. 8 is a perspective view of a tissue paper product according to another embodiment of the present invention.

DESCRIPTION OF EMBODIMENTS

Hereinafter, embodiments of the present invention will be described below with reference to FIGS. 1 to 8.

As illustrated in FIGS. 1 to 3, a method of producing a scented tissue paper product X1 according to the present embodiment includes performing shrink wrapping in which a tissue paper housing 1 obtained by carrying fragrance-containing microcapsules 31 on an inner surface of a housing box using a binder 30 is covered with a shrink film 2, and the shrink film 2 is exposed to hot air w so as to be attached to the tissue paper housing 1; causing the fragrance-containing microcapsules 31 to be detached from the binder 30 by heating the tissue paper housing 1 at the time of the shrink wrapping; and providing the scent for tissue paper 20 in the housing box.

The tissue paper housing 1 according to the present embodiment stores tissue paper 20 in the housing box 10 as illustrated in FIG. 4. According to the form illustrated in the figure, a so-called pop-up type tissue paper housing is configured such that a bundle 20*t* of plural sheets of tissue papers 20, . . . , 20 being folded and stacked on each other is stored in a rectangular parallelepiped housing box 10 having a perforation line 12 on an upper surface 11 thereof and the tissue paper 20 can be taken out from an outlet 12*x* formed by tearing through the perforation line 12. In regard to the approximate size of the housing box 10, a longitudinal edge L1 is in a range of 110 mm to 320 mm, a lateral edge L2 is in a range of 70 mm to 200 mm, and a height L3 is in a range of 40 mm to 150 mm.

Known paper materials or paper processing materials including various pulps such as virgin pulp and waste paper pulp as raw materials can be employed for the base material of the housing box 10. The base material of the housing box 10 is desirably coated cardboard having a basis weight of 250 g/m$^2$ to 500 g/m$^2$.

As understood from FIGS. 4 and 5, the assembly structure of the housing box 10 illustrated in the figures is a structure in which a bottom surface 13 and one long side surface 14 are pasted to each other using a paste margin 13A to be cylindrical, respective flaps F, . . . , F extending from the upper surface 11, the bottom surface 13, and the long side surface 14 that connects the upper surface with the bottom surface are folded toward the inner surface of the box, and contact portions of the respective flaps F, . . . , F are bonded to each other using a hot melt adhesive or the like to form a short side surface 15. Moreover, FIG. 5 is a view illustrating a carton blank 40 before assembly of the housing box when seen from the surface which is the inner surface side of the housing box 10. For the sake of understanding, respective portions are denoted by reference numerals after the assembly.

As understood from the figures, in the tissue paper housing 1 of the present embodiment, a film 35 provided with a slit is disposed on the dispensing opening 12*x* of the housing box 10. The film 35 provided with a slit is larger than an area 12*a* surrounded by the perforation line 12, has a square or oval shape, and is attached to the outside of the area 12*a* surrounded by the perforation line 12 using an adhesive so as not to influence, particularly, on peeling off of the perforation line 12 on the inner surface side of the upper surface of the box. A slit 35*s* in the film 35 provided with a slit is positioned in the area 12*a* surrounded by the perforation line 12 along the longitudinal direction, and accordingly, an outlet 12*x* is formed on the upper surface 11 of the housing box and the film 35 provided with a slit and the slit 35*s* are exposed through the outlet 12*x* by peeling off of the area 12*a* surrounded by the perforation line 12 along the perforation line 12 as illustrated in FIG. 4. In addition, the tissue paper 20 can be drawn out one by one from the slit 35*s*.

As illustrated particularly in FIG. 3, the tissue paper housing 1 according to the present invention has a characteristic in which the fragrance-containing microcapsules 31 are carried on the inner surface of the housing box 10 using the binder 30.

The fragrance-containing microcapsules 31 are formed by encapsulating a fragrance in microcapsules. The outer shell thereof is not limited and examples thereof include a melamine resin, a urethane resin, and a urea resin. Among these, a melamine resin is preferable from the viewpoints of moderate disintegration properties and fragrance permeability. In the present invention, a method of forming microcapsules is not particularly limited. The method can be suitably selected from chemical methods such as an in-situ method and an interfacial polymerization method. The film thickness of a microcapsule is not particularly limited, but is approximately in a range of 0.1 μm to 1.0 μm and preferably in a range of 0.1 μm to 0.5 μm.

Moreover, the average particle diameter of the fragrance-containing microcapsules 31 according to the present embodiment is preferably in a range of 10 μm to 50 μm. When the average particle diameter is in this range, the fragrance ratio with respect to the weight of capsules can be increased so that desired flavoring can be performed. In this case, since there is a concern that capsules are collapsed during the production and the yield thereof is decreased when the capsule diameter is increased, the more preferable average particle diameter of the fragrance-containing microcapsules 31 is in a range of 10 μm to 20 μm. Further, the average particle diameter here is based on the median diameter.

A suitable fragrance can be used as the fragrance encapsulated in microcapsules according to the present embodiment, and examples thereof include natural fragrances such as lemon oil, grapefruit oil, rosemary oil, peppermint oil, mandarin oil, lime oil, citron oil, chamomile oil, lavender oil, rose oil, and spearmint oil; synthetic fragrances, for example, alcohols such as linalool, citronellol, menthol, and geraniol; and chemical materials such as ethyl 2-methylbutanoate, β-pinene, isoamyl acetate, ethyl 2-methylpentanoate, β-myrcene, ethyl hexanoate, 3-methyl-2-butene-1-ol acetate, 3-hexene-1-ol acetate, tetrahydro-4-methyl-2-(2-methylpropyl) 2H-pyran, isocyclocitral, 2,4-dimethyl-7-octene-2-ol, 3,7-dimethyl-1,6-octadiene-3-ol, 4-tert-butylcyclohexyl acetate, 2-(1,1-dimethylethyl)cyclohexanol, 1-phenylethyl acetate, and 1,1-dimethyl-2-phenylethyl butanoate. These may be used alone or as a formulated flagrance by combining plural kinds thereof. The selection of a flagrance may be made by blending desired flagrances.

The binder 30 that allows the inner surface of the housing box to carry the flagrance-containing microcapsules 31 can fix the flagrance-containing microcapsules 31 to the inner surface of the housing box and allows the flagrance-containing microcapsules 31 to be detached therefrom by heating the tissue paper housing 1 at the time of shrink wrapping. The flagrance-containing microcapsules 31 may be detached from the inner surface thereof by being melted through the heating of the tissue paper housing 1 at the time of shrink wrapping. The present inventors found that the temperature of the surface in the box of the tissue paper housing 1 is approximately in a range of 55° C. to 85° C. at the time of shrink wrapping. Accordingly, it is preferable that the binder 30 has a melting point of 55° C. to 85° C. The flagrance-containing microcapsules 31 can securely transition to the tissue paper 20 through the heating at the time of shrink wrapping. Particularly preferred examples of the binder 30 having such a melting point include gelatin, agarose, agar, and carrageenan. Such binders 30 are suitable for the tissue paper 20 which is frequently used for applications of being direct contact with the skin since such binders 30 have an affinity for a paper material which is the base material of the housing box 10 and are highly safe such that the binders can be used for food. Further, since these binders 30 have moisture retaining properties, particularly the tissue paper 20 has excellent compatibility with moisturizing tissue paper that includes a polyol as an active component and exhibits a moisturizing effect using the hygroscopicity. That is, when such binders 30 are used, the inside of the housing box 10 is in an environment in which the humidity is easily maintained to be high and moisturizing tissue paper in the housing box is unlikely to be dried. Examples of the polyol serving as a preferable humectant according to the present invention include polyhydric alcohols such as glycerin, diglycerin, propylene glycol, 1,3-butylene glycol, polyethylene glycol, and derivatives thereof; and saccharides such as sorbitol, glucose, xylitol, maltose, maltitol, mannitol, and trehalose.

Here, according to the method of producing the tissue paper housing 1 of the present embodiment, as illustrated in FIG. 6, it is preferable that a carton blank base material 40*x* before the film 35 provided with a slit is attached thereto is coated with a fragrance solution including the fragrance-containing microcapsules 31 and the binder 30, using a coating device 55, the film 35 provided with a slit is attached thereto to form the carton blank 40, and then the tissue paper housing 1 is produced using the carton blank 40. More specifically, a suitable site on the surface which becomes the inner surface of the housing box of the carton blank base material 40*x* to which the film 35 provided with a slit is not attached is coated with a fragrance solution including the fragrance-containing microcapsules 31 and the binder 30 using the coating device 55 in advance. Further, glue for bonding the film 35 provided with a slit simultaneously with or after the coating is provided for a predetermined position and the process advances to the process of attaching the film 35 provided with a slit.

In addition, a film sheet 35*c* is sequentially fed from a web roll 35*x* around which the film sheet which becomes the film 35 provided with a slit is wound, a slit is formed using a slit cutter 52 and cut to have a suitable length using a rotary cutter 50 provided with a cutter blade 50A on the peripheral surface of the roll along the width direction, and then the film sheet transitions and is conveyed to a roll 51 which has a vacuum function of facing the rotary cutter 50.

Further, the film 35 provided with a slit is laminated on a predetermined position of the carton blank base material 40*x*, to which the sequentially fed film 35 provided with a slit for which an adhesive glue is provided at the predetermined position in advance is not attached yet, so that the both are attached to each other, and then the carton blank 40 to which the film 35 provided with a slit is attached is produced. Moreover, the carton blank 40 is produced by being assembled to have a box shape, inserting the bundle 20*t* of tissue papers thereinto, and sealing the flaps F, . . . , F. With this method, the productivity of the scented tissue paper product X1 is not degraded. In the form of the figure, the carton blank base material 40*x* is coated with the flagrance solution using the coating device 55 and then the process of attaching the film 35 provided with a slit to the carton blank base material 40*x* is continuously performed, but the coating of the carton blank base material 40*x* with the flagrance solution may be carried out in another machine which is not continued with the film 35 provided with a slit. Moreover, a drying process may be provided after the coating process using the coating device 55.

The method of coating the carton blank base material 40*x* with the flagrance solution is not particularly limited, but it is preferable to use a printing machine such as a blade coater, a rod coater, a flexo coater, or a gravure coater, from the viewpoint of excellent productivity. It is preferable that the coating amount thereof is in a range of 1 $g/m^2$ to 30 $g/m^2$, preferably in a range of 5 $g/m^2$ to 20 $g/m^2$, and more preferably in a range of 8 $g/m^2$ to 15 $g/m^2$ from the viewpoint that the flagrance-containing microcapsules 31 are easily transferred to the tissue paper 20 and the bundle 20*t* of tissue papers is easily pushed into the housing box 10*x*.

Here, at the time of coating the carton blank base material 40*x* with the coating solution, it is preferable that a portion, to which an adhesive glue for bonding the film 35 provided with a slit is applied, is not coated with the flagrance solution such that the film 35 provided with a slit is not peeled off due to melting of the binder 30 or other reasons during when the subsequent process of the shrink wrapping is performed. Further, in a case where a structure in which the flaps F are attached to each other on the short side surface 15 of the housing box 10 is formed as the form illustrated in the figure, since there is a concern that the adhesiveness between the flaps F is degraded due to the melting of the binder 30 or other reasons during when the shrink wrapping is performed, it is preferable that portions of the flaps F being attached to each other are not coated with the flagrance solution.

The specific properties of the fragrance solution are not limited. The fragrance solution can be applied as the capsule slurry having an appropriate viscosity.

A known method can be employed as the method of producing the tissue paper housing using the above-described carton blank 40. For example, as illustrated in FIG. 7, the tissue paper housing is produced by assembling the carton blank 40 in a state in which only flaps on one side of the longitudinal direction are open without being closed, laminating the end surface of the bundle 20*t* of tissue papers on an open short surface 40K, pressing an end surface 20*s*, which does not face the open short surface 40K on which the bundle 20*t* of tissue papers is laminated, with a push rod 60 such that the bundle 20*t* of tissue papers is pushed into the housing box, and then sealing the open short surface 40K. From the viewpoint of excellent productivity, it is preferable that the tissue paper housing is produced in a state in which the bundle 20*t* of tissue papers and the housing box 10*x* with an open short surface on one side run in parallel with each other on a conveyor or the like.

The tissue paper 20 stored in the housing box 10 is not particularly limited, but the problems of moisturizing tissue paper, in which an aroma is provided by directly applying flagrance-containing microcapsules of the related art, are solved according to the present invention as described above. Therefore, it is particularly effective that the tissue paper 20 to be stored in the housing box 10 is moisturizing tissue paper.

The structure of the bundle 20*t* of tissue papers 20 is a so-called pop-up type, and the bundle 20*t* of tissue papers can be produced using a known inter folder such as a multi-stand type inter folder or a rotary type inter folder. The number of laminated sheets is preferably in a range of 120 pairs to 240 pairs.

In addition, known procedures of shrink wrapping of the tissue paper housing 1 are employed for the shrink wrapping according to the present embodiment. In the present embodiment, as illustrated in FIG. 2, the tissue paper housing 1 is covered with the shrink film 2, the covered tissue paper housing 1 is allowed to pass through a shrink wrapping device 70 which is also referred to as a shrink tunnel or a heater tunnel and exposed to hot air W so that the shrink film 2 is shrunk, and the shrink film 2 is attached to the outer surface of the housing box of the tissue paper housing 1, thereby completing the wrapping.

Further, the shrink film 2 can be suitably selected from known polyethylene films used for wrapping tissue paper products. Specific examples thereof include a polyethylene film, a polyvinyl chloride film, a polypropylene film, and a polystyrene film which have heat shrinkability.

The temperature of the hot air W at the time of performing shrink wrapping is preferably in a range of 180° C. to 250° C. and the time for exposing the film to hot air is preferably 5 seconds to 20 seconds. The temperature and the time can be suitably selected within the above-described range in consideration of the outside temperature, the type of shrink film, the melting temperature of the outer shell of a microcapsule, the size of the tissue paper housing 1 or the like it is possible to reliably perform the shrink wrapping without denaturing the tissue paper in the housing box and to exhibit the action effects of the present invention. Moreover, the present inventors found that the temperature of the outer surface of the housing box becomes 75° and the temperature of the inner surface of the housing box becomes 60° C. in a case where a tissue paper housing 1 having a typical size is used and the shrink wrapping is performed under the conditions of a temperature of 180° C. for 6 seconds; and the temperature of the inner surface of the housing box is increased to 100° C. in a case where the shrink wrapping is performed under the conditions of a temperature of 250° C. for 20 seconds. Accordingly, in consideration of particularly the temperature of the inner surface of the housing box within the above-described range under such conditions, a binder that melts in the above-described temperature and flagrance-containing microcapsules which are not melted or collapsed at the above-described temperature may be selected. In addition, the temperature of a melamine resin and a urea resin exemplified above as an outer sheet of a flagrance-containing microcapsule is approximately 150° C.

Moreover, when the tissue paper housing is shrink-wrapped, only one tissue paper housing may be individually wrapped as illustrated in FIG. 1 or a plurality of tissue paper housings are arranged such that the upper surfaces and the bottom surfaces face each other as illustrated in FIG. 2 or 8 and the tissue paper housings are shrink-wrapped to obtain products. In this case, since the upper surfaces and the bottom surfaces of some tissue paper housings are not exposed to the outside, the surfaces are not exposed to hot air at the time of shrink wrapping. Consequently, as positions of the tissue paper housings 1 that carry the flagrance-containing microcapsules 31, the inner surfaces of the long side surfaces 14 which are portions in which all tissue paper housings 1 are exposed to outside when the tissue paper housings 1 are arranged in parallel as illustrated in FIG. 8 are preferable.

In the production method according to the present invention, flagrance-containing microcapsules 31 which are not detached from the binder 30 at the time of shrink wrapping may be present. Since such flagrance-containing microcapsules 31 remaining in the binder 30 are also in a state of being easily detached from the binder when compared to the state before heating at the time of shrink wrapping, the flagrance-containing microcapsules 31 are detached from the binder and applied to the tissue paper 20 due to dynamic stimuli such as transportation after production of tissue paper products is completed. The tissue paper product produced according to the present invention is excellent in terms that transition effect of the flagrance-containing microcapsules 31 to the tissue paper 20 is exhibited even if the flagrance-containing microcapsules 31 are detached from the binder 30 at the time of shrink wrapping and after the shrink wrapping. Further, even in a case of flagrance-containing microcapsules 31 which have not been detached therefrom, auxiliary effect that the flagrance is gradually evaporated and the aroma is distributed in the tissue paper housing 1 by microcapsules being collapsed or cracked in the housing box due to physical stimuli at the time of pop-up of the tissue papers 20, . . . , 20 is exhibited. Particularly, in a case of flagrance-containing microcapsules having a melamine resin as an outer shell, this auxiliary effect is effectively exhibited because the flagrance is easily evaporated through the outer shell.

REFERENCE SIGNS LIST

X1: scented tissue paper product
1: tissue paper housing
2: shrink film
30: binder
31: flagrance-containing microcapsules
20: tissue paper
20*t*: bundle of tissue papers
10: housing box
11: upper surface of housing box
12: perforation line
12*a*: area surrounded by perforation line
12*x*: outlet
13: bottom surface of housing box
13A: paste margin
14: long side surface of housing box
15: short side surface of housing box
F: flap
35: film provided with slit
35*s*: slit
35*x*: web roll
55: coating device
40*x*: carton blank base material
40: carton blank
35*c*: film sheet
52: slit cutter
50A: cutter blade
50: rotary cutter
51: roll having vacuum function
40K: open short surface
20*s*: end surface of bundle of tissue papers
60: push rod
10*x*: housing box with open short surface on one side
W: hot air
70: shrink wrapping device

The invention claimed is:

1. A method of producing a scented tissue paper product comprising:

performing shrink wrapping in which a tissue paper housing obtained by carrying fragrance-containing microcapsules on an inner surface of the tissue paper housing using a binder is covered with a shrink film and the shrink film is exposed to hot air so as to be attached to the tissue paper housing; and causing the fragrance-containing microcapsules to be detached from the binder by heating the tissue paper housing at the time of the shrink wrapping.

2. The method of producing a scented tissue paper product according to claim 1, wherein the binder has a melting point of 55° C. to 85° C.

3. The method of producing the scented tissue paper product according to claim 1, wherein the binder is one of gelatin, agarose, agar, or carrageenan.

4. The method of producing the scented tissue paper product according to claim 1, wherein the tissue paper housing is a housing which has a rectangular parallelepiped shape and in which a film provided with a slit is provided on the inner surface of an upper surface of the tissue paper housing and fragrance-containing microcapsules are carried at least on a side surface using a binder.

5. The method of producing the scented tissue paper product according to claim 4, wherein the shrink wrapping is performed by arranging a plurality of tissue paper housings on an upper surface and a bottom surface such that the tissue paper housings face each other.

6. The method of producing the scented tissue paper product according to claim 1, further comprising;

coating a carton blank base material, before a film provided with a slit is attached thereto, with a fragrance solution that contains fragrance-containing microcapsules and a binder;

attaching the film provided with the slit to the carton blank base material to form a carton blank; and producing the tissue paper housing using the carton blank.

7. The method of producing the scented tissue paper product according to claim 6, wherein a portion of the carton blank base material, to which an adhesive for bonding the film provided with the slit is applied, is not coated with the fragrance solution.

8. The method of producing the scented tissue paper product according to claim 1, wherein the tissue paper is moisturizing tissue paper including a humectant.

* * * * *